US009327527B2

(12) United States Patent
Emoto et al.

(10) Patent No.: US 9,327,527 B2
(45) Date of Patent: May 3, 2016

(54) PRINTING APPARATUS, CONVEYING APPARATUS, AND CONTROL METHOD

(71) Applicant: CANON KABUSHIKI KAISHA, Tokyo (JP)

(72) Inventors: Yuki Emoto, Tokyo (JP); Takaaki Ishida, Kawasaki (JP); Shuichi Tokuda, Kawasaki (JP); Toshirou Yoshiike, Kawasaki (JP); Tatsunori Shimonishi, Ebina (JP); Junichi Hirate, Kawasaki (JP); Kiyoshi Masuda, Kawasaki (JP); Tomoyuki Saito, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/017,125

(22) Filed: Sep. 3, 2013

(65) Prior Publication Data

US 2014/0078206 A1 Mar. 20, 2014

(30) Foreign Application Priority Data

Sep. 14, 2012 (JP) ..... 2012-203543

(51) Int. Cl.
*B41J 29/38* (2006.01)
*B41J 2/01* (2006.01)
*B41J 13/00* (2006.01)

(52) U.S. Cl.
CPC ..... *B41J 13/0009* (2013.01); *B41J 13/0027* (2013.01)

(58) Field of Classification Search
CPC ..... B41J 11/007; B41J 13/103; B41J 29/38; B41J 13/0027; B41J 13/0009
USPC ..... 347/16, 104
See application file for complete search history.

(56) References Cited

U.S. PATENT DOCUMENTS 5,602,571 A 2/1997 Suda et al.
6,801,332 B1 10/2004 Suga et al.

(Continued)

FOREIGN PATENT DOCUMENTS

CN 101096156 A 1/2008
CN 101844689 A 9/2010

(Continued)

OTHER PUBLICATIONS

U.S. Appl. No. 14/017,131, filed Sep. 3, 2013. Applicants: Takaaki Ishida, et al.

(Continued)

*Primary Examiner* — Jannelle M Lebron
(74) *Attorney, Agent, or Firm* — Fitzpatrick, Cella, Harper & Scinto

(57) ABSTRACT

A printing apparatus includes a printing unit, first and second conveying units conveying a printing medium, a driving unit driving the first and second conveying units, and a control unit controlling the driving unit. The conveyance state of the printing medium makes transition from a first conveyance state in which the printing medium is conveyed only by the first conveying unit to a second conveyance state in which the printing medium is conveyed by both the first and second conveying units. The control unit controls the driving unit based on a fluctuation in a load that mutually acts between the first and second conveying units through the printing medium to suppress a fluctuation in a conveyance amount at the time of the transition of the conveyance state from the first conveyance state to the second conveyance state.

9 Claims, 12 Drawing Sheets

(56) References Cited

U.S. PATENT DOCUMENTS

| | | | |
|---|---|---|---|
| 7,095,521 | B2 | 8/2006 | Yoshida |
| 7,744,186 | B2 | 6/2010 | Yoshida et al. |
| 8,235,492 | B2 | 8/2012 | Saito et al. |
| 8,328,320 | B2 | 12/2012 | Nakata |
| 2004/0080568 | A1 | 4/2004 | Matsuo et al. |
| 2004/0109037 | A1 | 6/2004 | Nunokawa et al. |
| 2007/0126837 | A1 | 6/2007 | Takahashi et al. |
| 2008/0073832 | A1 | 3/2008 | Sudo et al. |
| 2010/0045725 | A1 | 2/2010 | Saito et al. |
| 2012/0086968 | A1 | 4/2012 | Saito |

FOREIGN PATENT DOCUMENTS

| | | | |
|---|---|---|---|
| JP | 4-148958 | A | 5/1992 |
| JP | 2004-9686 | A | 1/2004 |
| JP | 2010-46994 | A | 4/2010 |

OTHER PUBLICATIONS

Chinese Office Action dated May 6, 2015 issued in corresponding Chinese Patent Application No. 201310422116.X.

FIG. 6

| | PHASE FLUCTUATION CONVEYANCE AMOUNT L | |
|---|---|---|
| | FIRST CONVEYANCE STATE (CONVEYANCE BY MAIN CONVEYANCE ROLLER) | THIRD CONVEYANCE STATE (CONVEYANCE BY DISCHARGE ROLLER) |
| S1 | $L_{LF1}$ | $L_{EJ1}$ |
| S2 | $L_{LF2}$ | $L_{EJ2}$ |
| S3 | $L_{LF3}$ | $L_{EJ3}$ |
| S4 | $L_{LF4}$ | $L_{EJ4}$ |
| S5 | $L_{LF5}$ | $L_{EJ5}$ |
| S6 | $L_{LF6}$ | $L_{EJ6}$ |
| S7 | $L_{LF7}$ | $L_{EJ7}$ |
| S8 | $L_{LF8}$ | $L_{EJ8}$ |

FIG. 9

| ROTATIONAL PHASE | LOAD APPLIED TO MAIN CONVEYANCE ROLLER | CONVEYANCE AMOUNT IN EACH CONVEYANCE STATE | | |
|---|---|---|---|---|
| | | FIRST CONVEYANCE STATE (ONLY MAIN CONVEYANCE ROLLER) | THIRD CONVEYANCE STATE (ONLY DISCHARGE ROLLER) | SECOND CONVEYANCE STATE (BOTH CONVEYANCE ROLLERS) |
| $\theta_0$ | $F_0$ | – | – | – |
| $\theta_1$ | $F_1$ | $\beta_{LF1}$ | $\beta_{EJ1}$ | $\beta_{LFEJ1}$ |
| $\theta_2$ | $F_2$ | $\beta_{LF2}$ | $\beta_{EJ2}$ | $\beta_{LFEJ2}$ |
| $\theta_3$ | $F_3$ | $\beta_{LF3}$ | $\beta_{EJ3}$ | $\beta_{LFEJ3}$ |
| : | : | : | : | : |
| $\theta_n$ | $F_n$ | $\beta_{LFn}$ | $\beta_{EJn}$ | $\beta_{LFEJn}$ |
| $\theta_{n+1}$ | $F_{n+1}$ | $\beta_{LFn+1}$ | $\beta_{EJn+1}$ | $\beta_{LFEJn+1}$ |
| : | : | : | : | : |

FIG. 11

| | PHASE FLUCTUATION CONVEYANCE AMOUNT L | |
|---|---|---|
| | FIRST CONVEYANCE STATE (CONVEYANCE BY MAIN CONVEYANCE ROLLER) | THIRD CONVEYANCE STATE (CONVEYANCE BY DISCHARGE ROLLER) |
| S1 | $L_{LF1}$ | $L_{EJ1}$ |
| S2 | $L_{LF2}$ | $L_{EJ2}$ |
| S3 | $L_{LF3}$ | $L_{EJ3}$ |
| S4 | $L_{LF4}$ | $L_{EJ4}$ |
| S5 | $L_{LF5}$ | $L_{EJ5}$ |
| S6 | $L_{LF6}$ | $L_{EJ6}$ |
| : | : | : |
| S2000 | $L_{LF2000}$ | $L_{EJ2000}$ |

FIG. 13

EQUATION 1

$$\beta_{LFEJ} = \beta_{LF} + \alpha_{LF} \cdot F_{LF}$$
$$\beta_{LFEJ} = \beta_{EJ} + \alpha_{EJ} \cdot F_{EJ}$$

EQUATION 2

$$F_{LF} = \frac{\beta_{EJ} - \beta_{LF}}{\alpha_{LF} + \alpha_{EJ}}$$

EQUATION 3

$$X_{LF} = -(1/K_{LF}) \cdot \delta F_{LF}$$
$$X_{EJ} = -(1/K_{EJ}) \cdot \delta F_{EJ}$$

EQUATION 4

$$\beta_{LFEJ} = \beta_{LF} + \alpha_{LF} \cdot \frac{F_{n+1} + F_n}{2} - \frac{1}{K_{LF}} \cdot (F_{n+1} - F_n)$$
$$\beta_{LFEJ} = \beta_{EJ} - \alpha_{EJ} \cdot \frac{F_{n+1} + F_n}{2} + \frac{1}{K_{EJ}} \cdot (F_{n+1} - F_n)$$

EQUATION 5

$$F_{n+1} = \frac{(\beta_{EJ} - \beta_{LF}) + \{(\alpha_{LF} - \alpha_{EJ})/2 + (1/K_{LF} + 1/K_{EJ})\} F_n}{(\alpha_{LF} + \alpha_{EJ})/2 - (1/K_{LF} + 1/K_{EJ})}$$

PRINTING APPARATUS, CONVEYING APPARATUS, AND CONTROL METHOD

BACKGROUND OF THE INVENTION

1. Field of the Invention

The present invention relates to a conveyance technique of a printing medium or the like.

2. Description of the Related Art

In recent years, a printing apparatus such as a copying machine or a printer is often used to print a photographic image. Especially, an inkjet printing apparatus can form an image of the same quality as a silver halide photo on the strength of reduction of the ink droplet size and improvement of image processing technologies.

Against the backdrop of the demand for higher image quality, a high accuracy is required to convey a printing medium. In particular, regarding a roller for conveying the printing medium, a very high accuracy is needed because the printing medium conveyance amount is almost proportional to the outer diameter of the roller. However, the accuracy of finishing of the roller is limited. Hence, there is a need of conveyance control capable of implementing a high conveyance accuracy regardless of a variation in the outer diameter of the roller or decentering of the roller.

In general, the main printing unit of the printing apparatus is formed from a printhead and a plurality of conveyance rollers provided on the upstream or downstream side of the printhead. In the printing apparatus having this arrangement, the conveyance amount upon switching the roller involved in conveyance is particularly problematic concerning the printing medium conveyance accuracy. For example, when switching from a state in which the printing medium is conveyed only by the conveyance roller on the upstream side to a state in which the printing medium is conveyed by two conveyance rollers on the upstream and downstream sides, the conveyance accuracy may lower due to the influence of the conveyance amount difference between the conveyance rollers. This degrades the image quality. To cope with this problem, Japanese Patent Laid-Open No. 4-148958 proposes a method of correcting the conveyance amount upon switching the conveyance state.

In the state in which the printing medium is conveyed by the two conveyance rollers on the upstream and downstream sides, loads act to uniform the conveyance amounts of the conveyance rollers. More specifically, forces in opposite directions are applied to the conveyance rollers through the printing medium. The forces cause the conveyance rollers to slip and make their conveyance amounts equal.

Examine this phenomenon in more detail. Because of the loads acting on the conveyance rollers, another phenomenon also takes place in which the conveyance rollers bend to themselves. Since this bending displaces the conveyance rollers sandwiching the printing medium, the position of the printing medium changes as well. This leads to a decrease in the conveyance accuracy.

Additionally, immediately after the switching of the conveyance state, the loads applied to the conveyance rollers fluctuate and then transit to a stable state. Japanese Patent Laid-Open No. 4-148958 pays no attention to the load fluctuation upon switching the conveyance state.

SUMMARY OF THE INVENTION

The present invention provides a technique capable of coping with a fluctuation in the conveyance amount upon switching the conveyance state.

According to the present invention, there is provided, for example, a printing apparatus comprising: a printing unit configured to print an image on a printing medium; a first conveying unit configured to convey the printing medium; a second conveying unit provided downstream relative to the first conveying unit along a conveyance direction of the printing medium and configured to convey the printing medium; a driving unit configured to drive the first conveying unit and the second conveying unit; and a control unit configured to control the driving unit, a conveyance state of the printing medium making transition from a first conveyance state in which the printing medium is conveyed only by the first conveying unit out of the first conveying unit and the second conveying unit to a second conveyance state in which the printing medium is conveyed by both the first conveying unit and the second conveying unit, wherein the control unit controls the driving unit based on a fluctuation in a load that mutually acts between the first conveying unit and the second conveying unit through the printing medium to suppress a fluctuation in a conveyance amount at the time of the transition of the conveyance state from the first conveyance state to the second conveyance state.

Further features of the present invention will become apparent from the following description of exemplary embodiments (with reference to the attached drawings).

BRIEF DESCRIPTION OF THE DRAWINGS

FIG. 6 is a view showing an example of a table that stores conveyance amounts for the respective rotational phase intervals;

FIG. 9 is a view showing an example of a table that stores rotational phases, loads, and conveyance amounts;

FIG. 11 is a view showing an example of a table that stores the conveyance amounts for the respective rotational phase intervals in the printing apparatus shown in FIG. 10;

FIG. 13 is a view showing arithmetic expressions.

DESCRIPTION OF THE EMBODIMENTS

First Embodiment

Figure 1:
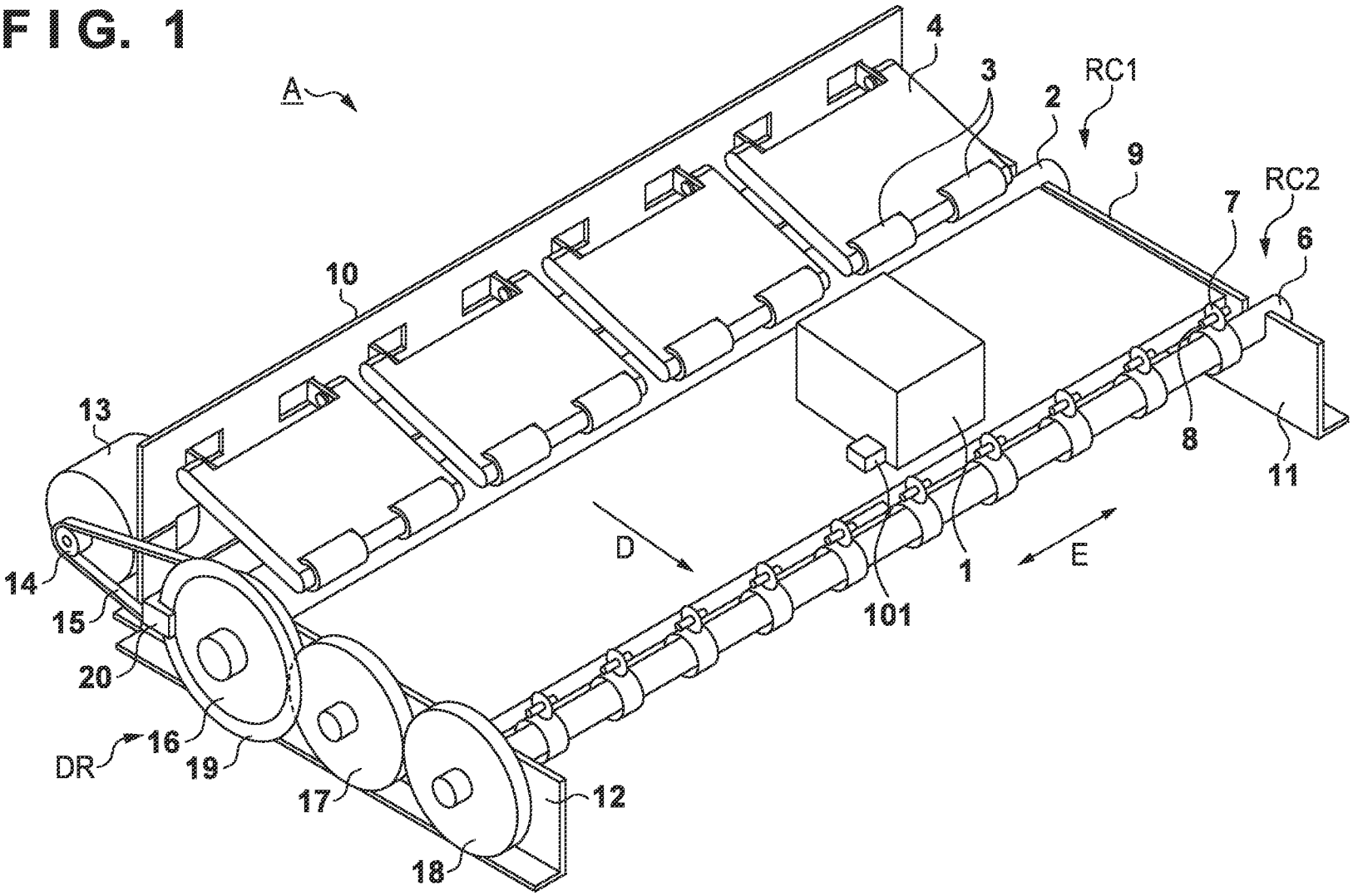
FIG. 1 is perspective view of the mechanism unit of a printing apparatus according to one embodiment of the present invention.

FIG. 1 is perspective view of the mechanism unit of a printing apparatus A according to this embodiment. In this embodiment, a case in which the present invention is applied to a serial inkjet printing apparatus will be described. However, the present invention is applicable to a printing apparatus of another type as well.

Note that "print" not only includes the formation of significant information such as characters and graphics, but also broadly includes the formation of images, figures, patterns, and the like on a print medium, or the processing of the medium, regardless of whether they are so visualized as to be visually perceivable by humans. Additionally, in this embodiment, a "print medium" is assumed to be a paper sheet, but may be cloth, a plastic film, or the like.

<Arrangement of Apparatus>

The printing apparatus A mainly includes a printing unit that prints on a printing medium, a sheet feeding unit (not shown) that feeds the printing medium, a sheet conveying unit that conveys the printing medium, and a control unit that controls the operation of each mechanism. The respective units will be described below.

The printing unit prints an image on a printing medium by a printhead (not shown) mounted on a carriage 1. The printing medium conveyed by the sheet conveying unit to be described later is supported by a platen 9 from below. The printhead located above discharges ink to print an image based on print image information on the printing medium. The carriage 1 can be moved by a driving mechanism (not shown) in a scanning direction E perpendicular to a conveyance direction D shown in FIG. 1. The carriage 1 prints the image in the direction of the printing medium width while moving in the scanning direction. The carriage 1 is provided with a scanner (optical sensor) 101.

The sheet feeding unit (not shown) is provided upstream relative to the printing unit along the conveyance direction. The sheet feeding unit separates each printing medium from a bundle thereof and supplies it to the sheet conveying unit.

The sheet conveying unit is provided downstream relative to the sheet feeding unit along the conveyance direction and conveys the printing medium fed from the sheet feeding unit. The sheet conveying unit includes a conveying unit RC1, a conveying unit RC2, and a driving unit DR. The main mechanisms of the sheet conveying unit are supported by a main side plate 10, a right side plate 11, and a left side plate 12.

The conveying unit RC1 is provided upstream relative to the printing unit along the printing medium conveyance direction. The conveying unit RC1 includes a main conveyance roller 2 and pinch rollers 3, and conveys the printing medium sandwiched between them. The main conveyance roller 2 is formed from a metal shaft with a surface coating of fine ceramic particles. The metal portions of the two ends are supported by the right side plate 11 and the left side plate 12, respectively, through bearings. Each pinch roller holder 4 holds a plurality of pinch rollers 3. The pinch rollers 3 are rotation members that rotate in accordance with the main conveyance roller 2. The pinch roller holders 4 press the pinch rollers 3 against the main conveyance roller 2 by pinch roller springs (not shown).

The conveying unit RC2 is provided downstream relative to the conveying unit RC1 and the printing unit along the printing medium conveyance direction. The conveying unit RC2 includes a discharge roller 6 and spurs 7, and conveys the printing medium sandwiched between them. The discharge roller 6 is formed from a metal shaft and rubber portions. The plurality of spurs 7 are attached to a spur holder (not shown) provided at a position facing the discharge roller 6. The spurs 7 are rotation members that rotate in accordance with the discharge roller 6. Springs 8 each formed from a rod-like coil spring press the spurs 7 against the discharge roller 6.

The driving unit DR drives the conveying unit RC1 and the conveying unit RC2. The driving unit DR includes a conveyance motor 13 formed from a DC motor as a driving source. The driving force of the conveyance motor 13 is transmitted to a pulley gear 16 provided on the axis of the main conveyance roller 2 through a conveyance motor pulley 14 and a timing belt 15. The main conveyance roller 2 is thus rotated. The pulley gear 16 includes a pulley portion and a gear portion. Driving of the gear portion is transmitted to a discharge roller gear 18 through an idler gear 17. The discharge roller 6 is thus driven as well.

The printing apparatus A includes a sensor for detecting the rotation amount of the main conveyance roller 2. This sensor includes a code wheel 19 and an encoder sensor 20. The code wheel 19 is directly coaxially coupled to the main conveyance roller 2. Slits are formed at a pitch of 150 to 360 lpi. The encoder sensor 20 is fixed to the left side plate 12, and reads the count and timing of passage of the slits on the code wheel 19.

An origin phase slit used to detect the origin phase of the main conveyance roller 2 is formed on the code wheel 19. The encoder sensor 20 detects the origin phase slit, thereby detecting the origin phase position of the main conveyance roller 2.

In this embodiment, the speed ratio between the main conveyance roller 2 and the discharge roller 6 is 1:1. The speed ratio between the conveyance roller gear 16, the idler gear 17, and the discharge roller gear 18, which form the driving transmission mechanism to the main conveyance roller 2 and the discharge roller 6, is also 1:1. With this arrangement, the rotation period of the main conveyance roller 2 equals those of the discharge roller 6 and the gears. When the main conveyance roller 2 rotates by one period, the discharge roller 6 and the gears also rotate by one period.

Hence, in this embodiment, the rotation amount of the discharge roller 6 can also be managed by the code wheel 19 and the encoder sensor 20 provided on the main conveyance roller 2. A rotation amount sensor for the discharge roller 6 may be provided, as a matter of course.

Furthermore, all the conveyance amount errors that occur due to geometrical shifts such as decentering of the rollers or the transmission errors of the gears and fluctuate in accordance with the rotational phases of the rollers and gears are integrated in correspondence with one rotation of the main conveyance roller 2.

Note that in this embodiment, a state in which the printing medium is conveyed only by the main conveyance roller 2 will be referred to as a first conveyance state. A state in which the printing medium is conveyed by cooperation of the main conveyance roller 2 and the discharge roller 6 will be referred to as a second conveyance state. A state in which the printing medium is conveyed only by the discharge roller 6 will be referred to as a third conveyance state. That is, when the printing medium is conveyed from the sheet feeding unit, the first conveyance state is obtained first. When the printing medium conveyance by the main conveyance roller 2 progresses, and the printing medium reaches the discharge roller 6, the second conveyance state is obtained. When the printing medium conveyance by the main conveyance roller 2 and the discharge roller 6 progresses, and the printing medium leaves the main conveyance roller 2, the third conveyance state is obtained.

In this embodiment, the conveyance amount in the second conveyance state is calculated assuming that the conveyance amount in the first conveyance state (that is, the conveyance amount of the main conveyance roller 2) and the conveyance amount in the third conveyance state (that is, the conveyance amount of the discharge roller 6) are known, as will be described later.

Figure 2:
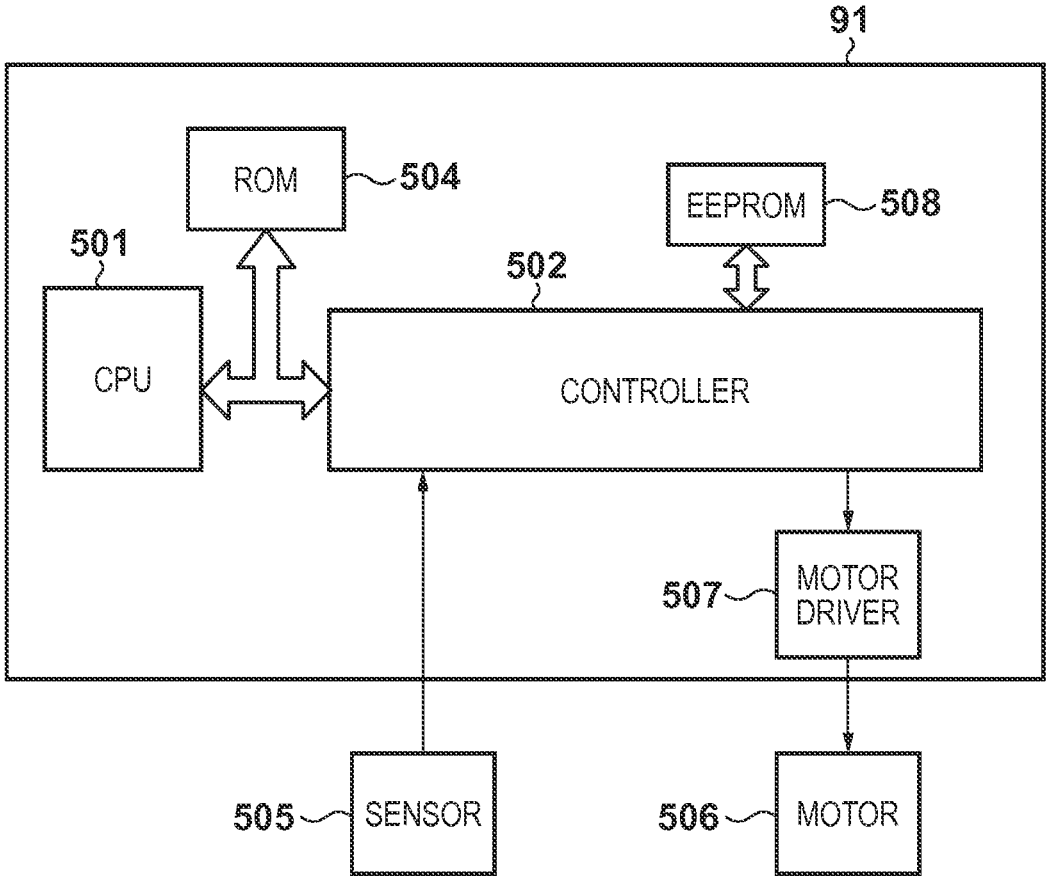
FIG. 2 is a control block diagram of the printing apparatus shown in FIG. 1.

FIG. 2 is a block diagram for explaining the arrangement of the control unit of the printing apparatus A. A control unit 91 controls the operation of each mechanism unit of the printing apparatus A. Only parts associated with the explanation of the present invention will be described here. A CPU 501 controls the entire printing apparatus A. A controller 502 assists the CPU 501 and controls the driving of a motor 506 and the printhead.

A ROM 504 stores formulas to be described later, the control programs of the CPU 501, and the like. An EEPROM 508 stores conveyance amount information and the like to be described later. Note that other storage devices may be employed in place of the ROM 504 and the EEPROM 508.

A motor driver 507 drives the motor 506. The motor 506 includes the above-described conveyance motor 13. A sensor 505 includes the encoder sensor 20 and an edge detector. The edge detector comprises, for example, a photosensor that is arranged on the upstream side of the printing unit and detects the passage of the leading edge of the printing medium.

For example, in accordance with the formulas stored in the ROM 504, the CPU 501 calculates the conveyance amount in the second conveyance state from the conveyance amount information stored in the EEPROM 508. Additionally, for example, at the time of conveyance of the printing medium, the CPU 501 drives the motor 506 through the motor driver 507 and rotates the main conveyance roller 2 and the discharge roller 6. At this time, the CPU 501 acquires origin phase information and rotation amount information of the main conveyance roller 2 from the encoder sensor 20, thereby precisely rotating it. The CPU 501 also detects the conveyance position of the printing medium based on printing medium edge detection by the edge detector, and grasps the timing of switching from the first conveyance state to the second conveyance state. The CPU 501 sets the rotation amount (the control amount of the driving unit DR to the motor 13) of each of the main conveyance roller 2 and the discharge roller 6 based on the timing and the calculation result of the second conveyance amount.

<Example of Control>

An example of control of the printing apparatus A will be described next mainly concerning conveyance control of the printing medium. Note that this embodiment assumes that the conveyance amount corresponding to a predetermined number of rotations of only the main conveyance roller 2 on the upstream side and the conveyance amount corresponding to a predetermined number of rotations of only the discharge roller 6 on the downstream side are different. This difference is intentionally given to the conveyance amounts of the rollers (for example, the roller diameter is changed). However, even if there is no intention of giving the difference, the finishing variation in the outer diameter between the rollers or decentering of the rollers eventually generates the difference.

In this embodiment, control is performed to suppress a conveyance amount fluctuation that occurs at the time of switching from the first conveyance state to the second conveyance state. Conveyance in the second conveyance state changes to a stable state as the conveyance continues. That is, the conveyance amount stabilizes by transition to a steady state. Hence, the conveyance amount fluctuation that occurs at the time of switching can be regarded as a conveyance amount that transiently changes in an unsteady state before the steady state. Hence, the following description will be made regarding the conveyance amount fluctuation that occurs at the time of switching as a transient conveyance amount change.

Let $\beta_{LF}$ be the conveyance amount in the first conveyance state, and $\beta_{EJ}$ be the conveyance amount in the third conveyance state. As described above, the conveyance amounts $\beta_{LF}$ and $\beta_{EJ}$ are different. Also let $\beta_{LFEJ}$ be the conveyance amount in the second conveyance state. The second conveyance state is a conveyance state in which the main conveyance roller 2 and the discharge roller 6 cooperatively convey the printing medium. Hence, in the second conveyance state, $\beta_{LFEJ}$ is decided by adjusting the conveyance amount between the main conveyance roller 2 and the discharge roller 6.

The conveyance amount of the printing medium is known to become small when a load is generated between the rollers through the printing medium, and the rollers slip. This can easily be confirmed by actually measuring the conveyance amount of the printing medium while applying a load to the printing medium using a suspended weight weighing a known value, and calculating the degree of slip with respect to the load of the weight.

A value concerning the conveyance change amount with respect to the load will be referred to as a conveyance characteristic coefficient $\alpha$. In this embodiment, the conveyance characteristic coefficient $\alpha$ is a value representing the slip amount with respect to the load. The value $\alpha$ will be described in more detail. The value $\alpha$ is calculated by {(conveyance amount when applying load)−(conveyance amount without applying load)}/(magnitude of load). Hence, the unit is (mm/N), and the value is negative. The value $\alpha$ can be obtained in advance by experiments for each of the main conveyance roller 2 and the discharge roller 6. The values are defined as $\alpha_{LF}$ and $\alpha_{EJ}$.

Since the conveyance amount $\beta_{LFEJ}$ is decided by causing the load to mutually act between the two shafts of the main conveyance roller 2 and the discharge roller 6, the conveyance amounts of the printing medium on the respective rollers are given by equations 1 shown in FIG. 13. Let $F_{LF}$ be the load applied to the main conveyance roller 2, and $F_{EJ}$ be the load applied to the discharge roller 6. Note that the positive direction of the two forces $F_{LF}$ and $F_{EJ}$ is opposite to the conveyance direction.

In equations 1 of FIG. 13, $F_{LF}$ and $F_{EJ}$ hold a relation $F_{LF}=-F_{EJ}$ based on the law of action and reaction. When this relation is applied to the equations 1 of FIG. 13, $F_{LF}$ is given by equation 2 of FIG. 13.

Hence, the force applied to the two rollers 2 and 6 in the second conveyance state can be obtained using equation 2 of FIG. 13. When the thus obtained force $F_{LF}$ is substituted into one of equations 1 of FIG. 13, the conveyance amount $\beta_{LFEJ}$ in the second conveyance state can be calculated. The bending amounts of the rollers can also be calculated based on this force and the rigidity coefficients of the rollers 2 and 6. Note that the rigidity coefficient is a value associated with the displacement amount of each roller with respect to the load, and can be calculated from the mechanical material physical properties and geometrical structures of each roller.

Equation 2 of FIG. 13 holds only under limited circumstances where the second conveyance state has become the steady state. In the process of growing the bending of the main conveyance roller 2 and the discharge roller 6, the main conveyance roller 2 and the discharge roller 6, which sandwich the printing medium, displace to themselves due to the bending. For this reason, the printing medium sandwich position changes. Since the position of the printing medium consequently changes, the conveyance amount apparently changes. The conveyance amount thus changes due to the displacement of the main conveyance roller 2 and the discharge roller 6.

Such a conveyance amount change transiently occurs. When the growth of bending of the main conveyance roller 2 and the discharge roller 6 is completed, the conveyance amount stabilizes. That is, the conveyance amount at the time of switching from the first conveyance state to the second conveyance state needs to consider even the transient change in the bending of each roller.

The above-described conveyance amount changes caused by the bending of the conveyance rollers can be expressed as equations 3 of FIG. 13. Let $X_{LF}$ and $X_{EJ}$ be the conveyance amount changes caused by bending of the main conveyance roller 2 and the discharge roller 6. Let $K_{LF}$ and $K_{EJ}$ be the rigidity coefficients of the main conveyance roller 2 and the discharge roller 6. Let $\delta F_{LF}$ and $\delta F_{EJ}$ be the change amounts of the load applied to the main conveyance roller 2 and the discharge roller 6. Note that the rigidity coefficients $K_{LF}$ and $K_{EJ}$ are calculated from the mechanical material physical properties and geometrical structures of the main conveyance roller 2 and the discharge roller 6.

As is apparent from equations 3 of FIG. 13, the displacement amounts generated by the changes in the load are calculated using the Hooke's law. When $X_{LF}$ and $X_{EJ}$ are added to equations 1 of FIG. 13, respectively, as new terms, conveyance amount changes considering the transient part can be expressed.

Considering the process of changing the load, $F_{LF}=F_0$, $F_1, \ldots, F_{n+1}, \ldots$ is set. As described above, $F_{LF}=F_{EJ}$ holds based on the law of action and reaction. Hence, the conveyance amounts until the load changes from $F_n$ to $F_{n+1}$ are given by equations 4 of FIG. 13. When simultaneous equations 4 of FIG. 13 are solved for $F_{n+1}$, $F_{n+1}$ can be expressed as equation 5 of FIG. 13 using $F_n$.

As can be seen from above explanation, the load amount $F_{n+1}$ at the next position can be calculated using the load amount $F_n$ at an arbitrary position. That is, when the initial condition (initial value) is given, the load fluctuation can recursively be calculated using equation 5 of FIG. 13. Note that the initial condition is the load $F_0$ applied to the main conveyance roller 2 and the discharge roller 6 upon switching from the first conveyance state to the second conveyance state, and $F_0$ is 0 as a matter of course.

Figure 3:
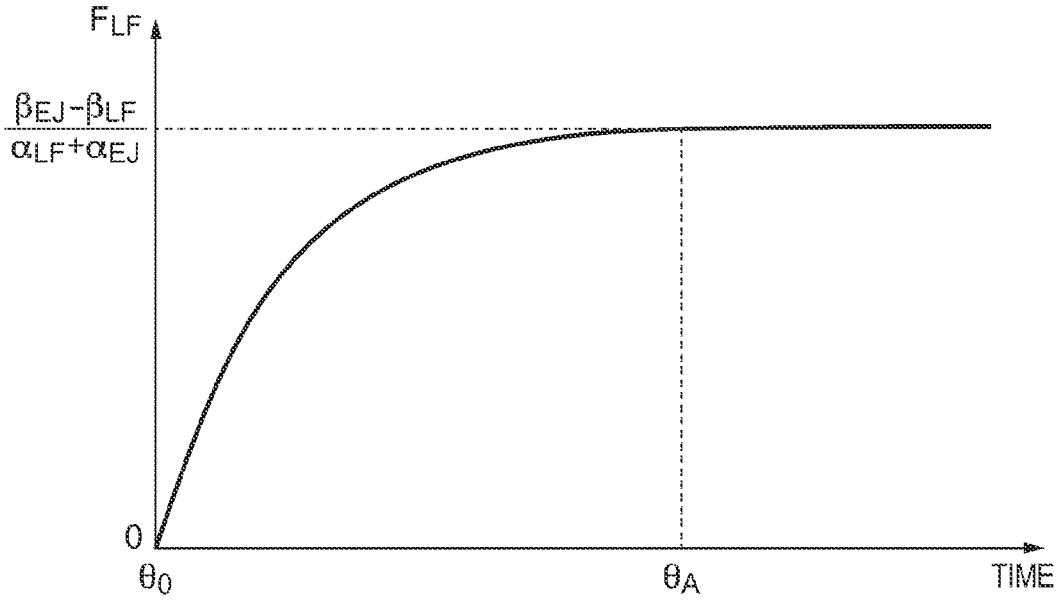
FIG. 3 is a graph showing a calculation result of a load applied to a conveyance roller.

FIG. 3 is a graph showing the calculation result of the load $F_{LF}$ that changes in accordance with the roller rotation amount after switching to the second conveyance state under a given condition. This graph represents a result when the conveyance amount of the main conveyance roller 2 is larger than that of the discharge roller 6. Let $\theta_0$ be the rotational phase at the instant of switching to the second conveyance state, and $\theta_A$ be the rotational phase at which the growth of bending of the roller is completed. The load from $\theta_A$ can be calculated by equation 2 of FIG. 13, as described above. That is, the transient change in the load occurs during conveyance from the rotational phase $\theta_0$ to $\theta_A$. The rotational phase $\theta_A$ changes depending on the conveyance characteristic coefficient $\alpha$ or a rigidity coefficient K of the main conveyance roller 2 and the discharge roller 6.

Figure 4:
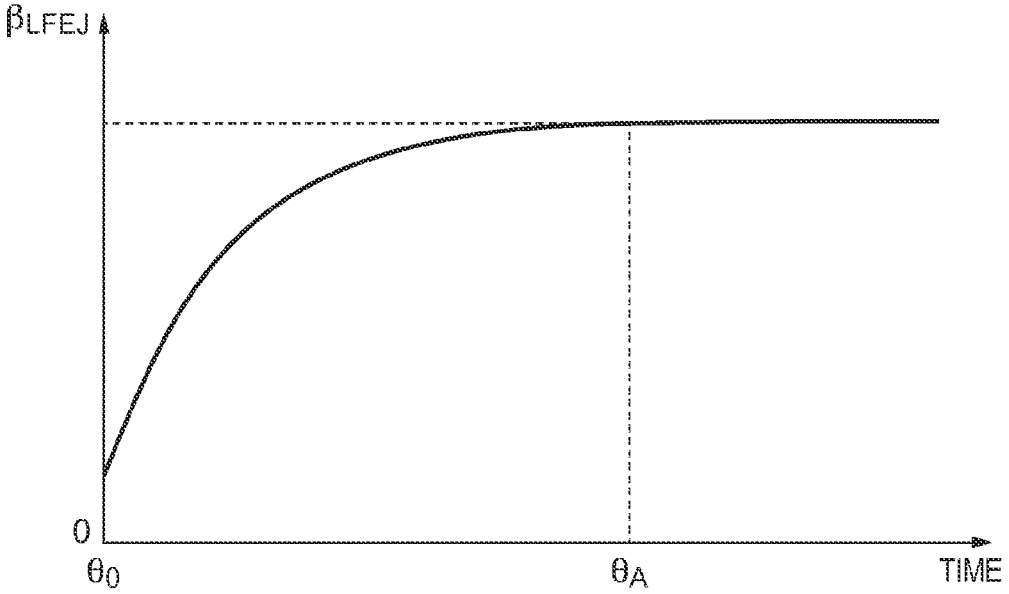
FIG. 4 is a graph showing a calculation result of the conveyance amount of a printing medium.

When the load fluctuation calculated above is substituted into the first equation of equations 4 of FIG. 13, the conveyance amount change $\beta_{LFEJ}$ including the transient part of the second conveyance state can be calculated. FIG. 4 shows a result of $\beta_{LFEJ}$ calculated using the load change according to the rotation amount shown in FIG. 3. Like the load, the conveyance amount also transiently changes from $\theta_0$ to $\theta_A$ and stabilizes from $\theta_A$. Hence, the conveyance amount change including the transient part can be calculated using the above-described equations and calculation process.

If the transient change is not taken into consideration, the conveyance amount in the region from $\theta_0$ to $\theta_A$ is the same as that from $\theta_A$. This is indicated by the alternate long and short dashed line in FIG. 4. When the transient change is taken into consideration, the conveyance accuracy can be improved by a degree corresponding to the difference between the solid line and the alternate long and short dashed line in FIG. 4.

Note that decentering of the main conveyance roller 2 and the discharge roller 6 and the like exist, the conveyance amount fluctuates at each rotation angle of a predetermined unit. Equations 4 and 5 of FIG. 13 can be applied in consideration of the conveyance amount fluctuation. At this time, substitution into equations 4 and 5 of FIG. 13 is done considering that $\beta_{LF}$ and $\beta_{EJ}$ change over time. This makes it possible to calculate the load F and the conveyance amount $\beta_{LFEJ}$ in the second conveyance state.

Figure 7:
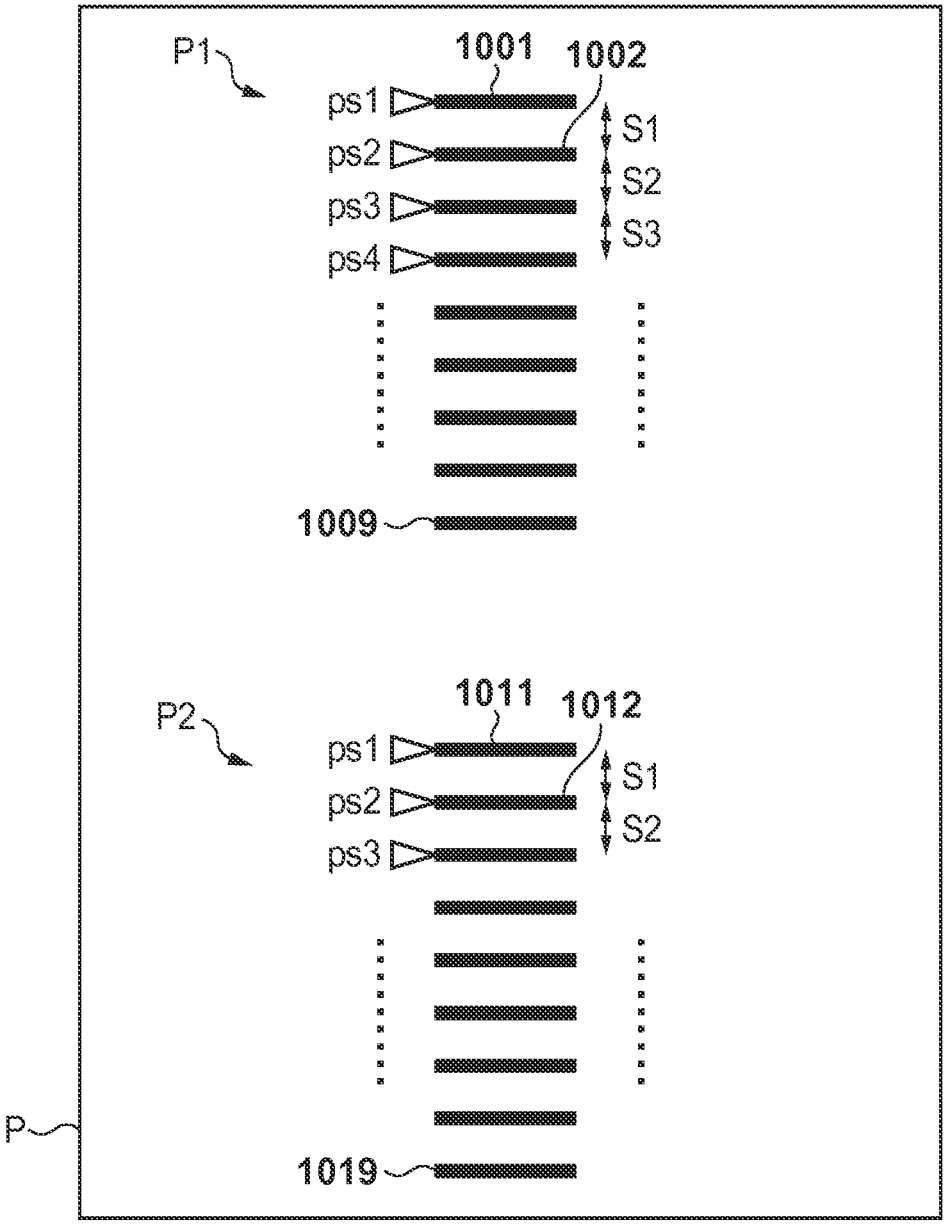
FIG. 7 is a view showing examples of test patterns used to acquire actual conveyance amounts.

A method of acquiring the conveyance amount (to be referred to as a phase fluctuation conveyance amount hereinafter) for a predetermined conveyance unit (in this case, for each phase (rotation angle)) in the first and third conveyance states by actual measurement will be described next with reference to FIGS. 5, 6, and 7. Note that the phase fluctuation conveyance amount acquisition method to be described below is merely an example, and another method can also be employed. This phase fluctuation conveyance amount acquisition can be executed in the factory or by the user before actual printing.

Figure 5:
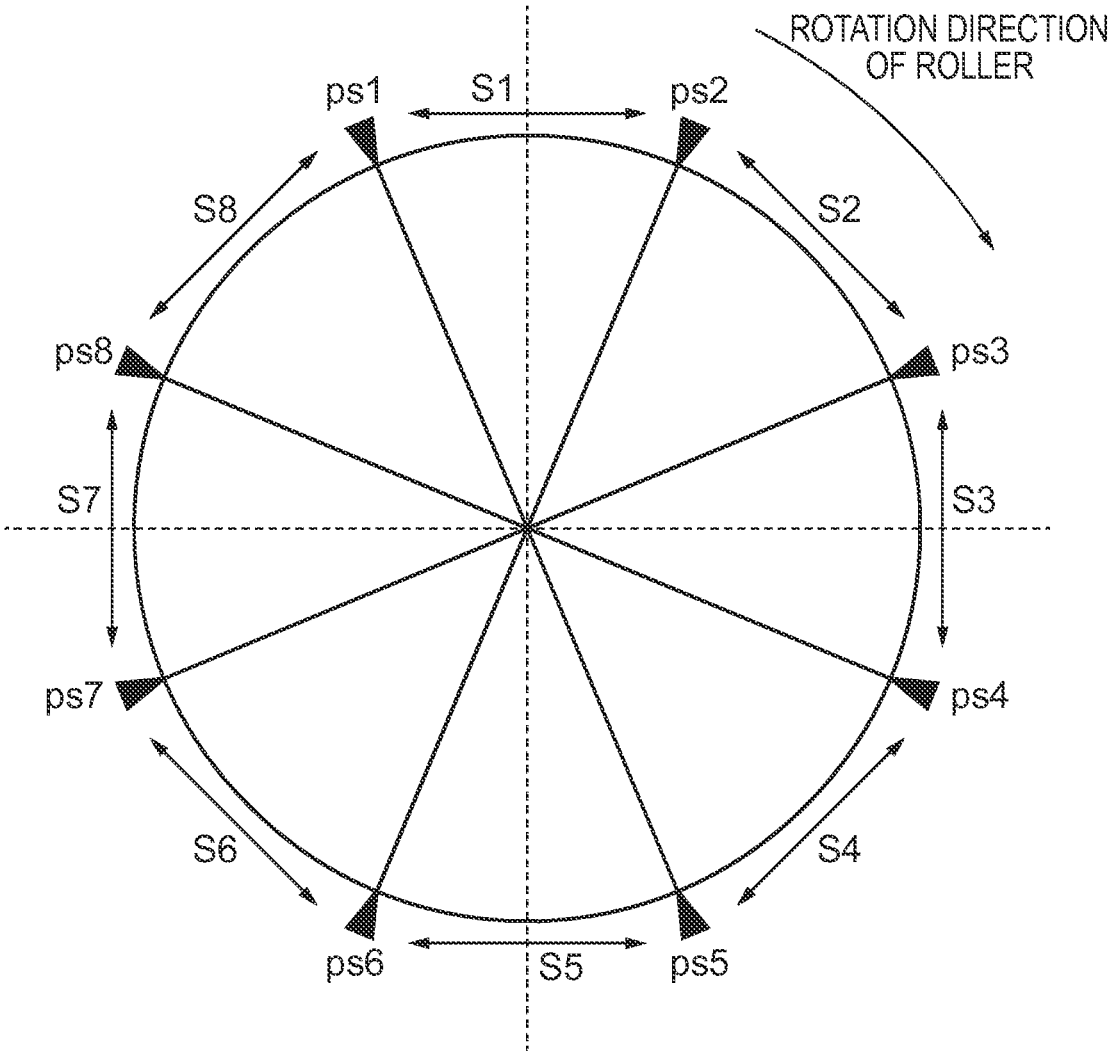
FIG. 5 is a conceptual view of the rotational phase intervals of a conveyance roller.

FIG. 5 is a conceptual view of eight rotational phase intervals S1 to S8 formed by dividing the roller periphery into eight parts. Referring to FIG. 5, each of positions ps1 to ps8 indicates the position of the rotational phase of the roller at which sheet conveyance starts upon printing a test pattern to be described later. Note that in this embodiment, the periphery of each of the main conveyance roller 2 and the discharge roller 6 is divided into eight parts, and conveyance amount correction is controlled for each of the eight rotational phase intervals S1 to S8.

FIG. 6 shows a table (conveyance amount information) that stores phase fluctuation conveyance amounts L for the predetermined rotational phase intervals in the first and third conveyance states.

The phase fluctuation conveyance amounts L are set as $L_{LF1}$ to $L_{LF8}$ and $L_{EJ1}$ to $L_{EJ8}$ for the main conveyance roller 2 and the discharge roller 6, respectively. The conveyance amounts $\beta_{LF}$ and $\beta_{EJ}$ when switching the conveyance state in the actual printing operation are decided using the phase fluctuation conveyance amounts L. Referring to FIG. 6, the phase fluctuation conveyance amounts L are stored for each of the eight rotational phase intervals S1 to S8 in correspondence with the first and third conveyance states. FIG. 7 is a view showing examples of test patterns used to acquire the phase fluctuation conveyance amounts L concerning the first and third conveyance states.

First, the above-described roller origin phase detection processing is performed to determine the origins of the rollers and set a state in which the rotational phase of each roller can be managed. In this state, test patterns P as shown in FIG. 7 are printed.

When printing the test patterns P, first, a test pattern P1 is printed in the first conveyance state in which the printing medium is conveyed only by the main conveyance roller 2. After the leading edge of the sheet has passed the main conveyance roller 2, the sheet is conveyed until the rotational phase of the main conveyance roller 2 reaches the position ps1.

At the sheet position ps1, a first test pattern 1001 is printed. After the pattern printing has ended, the conveyance of the sheet is started from the position ps1. The sheet is conveyed until the rotational phase of the roller reaches the position ps2, and a second test pattern 1002 is printed. In this case, the pattern interval between the first test pattern 1001 and the second test pattern 1002 corresponds to the conveyance amount in the rotational phase interval S1 from the position ps1 to the position ps2. Similarly, after the second pattern printing has ended, the conveyance of the sheet is started from the position ps2. The sheet is conveyed until the rotational phase of the roller reaches the position ps3, and a third test pattern 1003 is printed.

The above-described operation is repetitively performed until the rotational phase of the main conveyance roller 2 returns to the position ps1 again. In this embodiment, nine test patterns 1001 to 1009 are printed by repetitively performing the operation.

Subsequently, a test pattern P2 is printed in the third conveyance state in which the printing medium is conveyed only by the discharge roller 6. After the trailing edge of the sheet has passed the nip portion of the main conveyance roller 2, and the rotational phase of the discharge roller 6 has reached the position ps1, a first test pattern 1011 is printed. Next, the conveyance of the sheet is started from the position ps1. The sheet is conveyed until the rotational phase reaches the position ps2, and a second test pattern 1012 is printed. The above-described operation is repetitively performed until the rotational phase of the discharge roller 6 returns to the position ps1 again. Nine test patterns 1011 to 1019 are thus printed.

After all test patterns are printed, the pattern intervals between the test patterns 1001 to 1009 and 1011 to 1019 are measured by the scanner (optical sensor) 101 provided on the carriage 1.

The pattern intervals between the test patterns 1001 to 1009 correspond to the conveyance amounts in the rotational phase intervals S1 to S8 of the main conveyance roller 2, respectively. The pattern intervals between the test patterns 1011 to 1019 correspond to the conveyance amounts in the rotational phase intervals S1 to S8 of the discharge roller 6, respectively. Hence, the conveyance amounts in the rotational phase intervals S1 to S8 in the first conveyance state can be acquired by measuring the pattern intervals between the test patterns 1001 to 1009. Similarly, the conveyance amounts in the rotational phase intervals S1 to S8 in the third conveyance state can be acquired by measuring the pattern intervals between the test patterns 1011 to 1019.

Note that in this embodiment, nine test patterns are printed at eight pattern intervals in each of the first and third conveyance states. The number of pattern intervals equals the number of rotational phase intervals of each roller managed in the printing apparatus. In this case, for example, to improve the measurement accuracy, the number of pattern intervals may be larger than the number of rotational phase intervals of each roller. Alternatively, to shorten the measurement time, the number of pattern intervals may be smaller than the number of rotational phase intervals of each roller. However, if the number of pattern intervals and the number of rotational phase intervals of each roller are different, the conveyance amount for each rotational phase interval needs to be calculated by performing, for example, interpolation processing of measurement values.

The thus obtained conveyance amounts that fluctuate for each rotational phase interval are stored in $L_{LF1}$ to $L_{LF8}$ and $L_{EJ1}$ to $L_{EJ8}$ of the table shown in FIG. 6. With the series of operations, the phase fluctuation conveyance amounts L for the respective rotational phase intervals in the first and third conveyance states can be acquired. Using the thus obtained phase fluctuation conveyance amounts L, the conveyance amount β is decided and corrected at the time of the actual printing operation.

Figure 8:
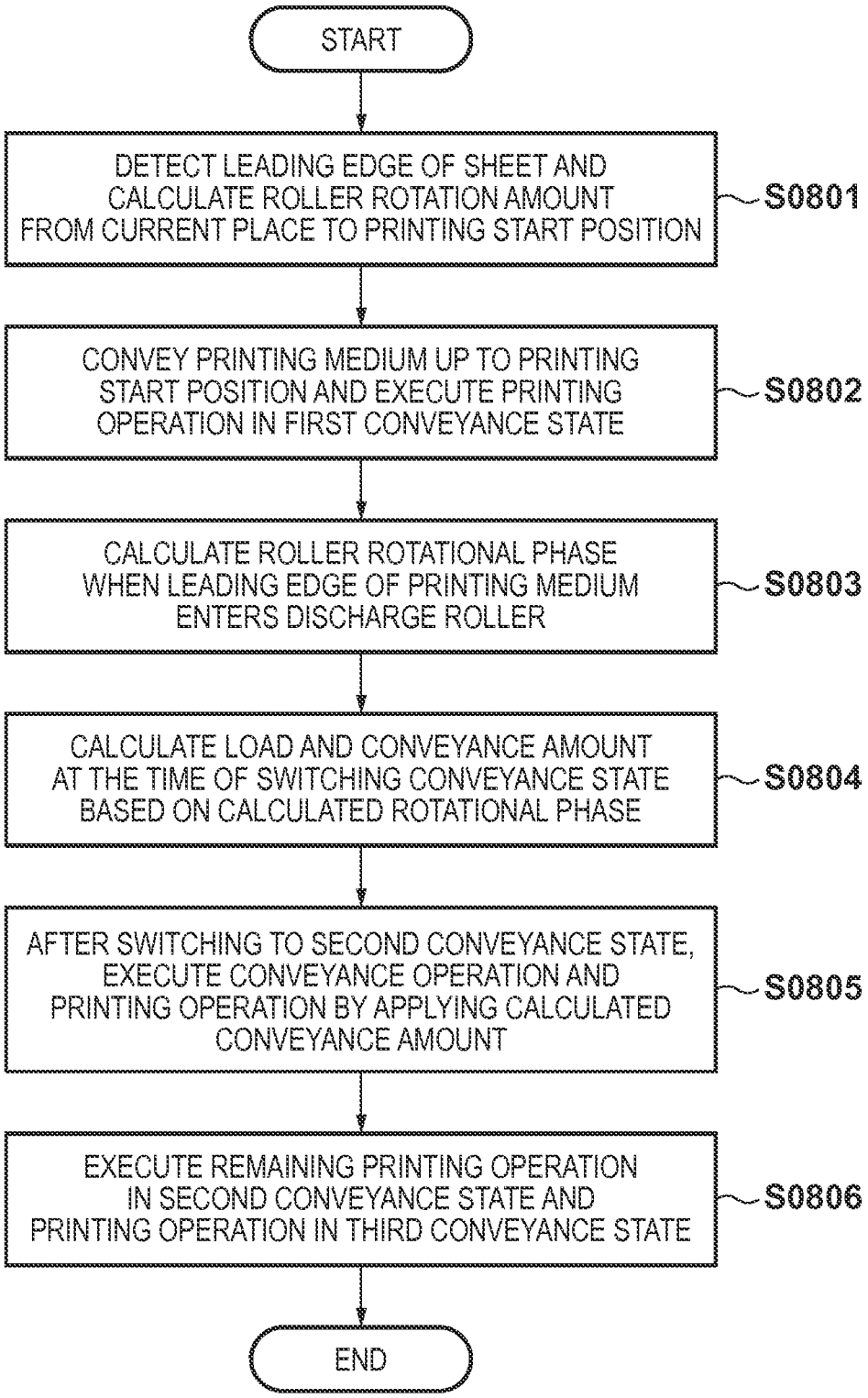
FIG. 8 is a flowchart of control at the time of a printing operation.

A method of controlling conveyance of the printing medium while performing the actual printing operation to suppress the fluctuation in the conveyance amount at the time of transition from the first conveyance state to the second conveyance state will finally be described with reference to FIGS. 8 and 9. FIG. 8 illustrates the control procedure in the actual printing operation. FIG. 9 shows a table that stores the load and conveyance amount when the leading edge of the printing medium enters the discharge roller 6, and the conveyance state is switched.

When the printing apparatus A receives the signal of the image printing operation, the sheet feeding unit feeds the sheet, and the sheet enters the edge detector on the upstream side of the main conveyance roller 2. Referring to FIG. 8, in step S0801, the edge detector detects the leading edge position of the sheet, and the roller rotation amount up to the actual printing start position is calculated. In step S0802, the sheet is conveyed based on the calculated roller rotation amount and positioned at the printing start position. At this time, the leading edge of the sheet passes the main conveyance roller 2, and transition to the first conveyance state occurs. After that, printhead movement by the carriage 1 and conveyance by the main conveyance roller 2 are repeated, thereby executing the printing operation.

In step S0803, the timing at which the sheet enters the discharge roller 6 is grasped. To do this, the roller rotation amount from the current sheet leading edge position to the entrance in the discharge roller 6 is calculated based on the sheet leading edge position detection result in step S0801. The rotational phases of the main conveyance roller 2 and the discharge roller 6 when the leading edge of the sheet enters the discharge roller 6 can be obtained from the rotation amount calculation result.

In step S0804, the loads applied to the main conveyance roller 2 and the discharge roller 6 at the time of switching to the second conveyance state and the conveyance amounts in each conveyance state are calculated and stored in the table shown in FIG. 9. First, the conveyance amounts $\beta_{LF}$ and $\beta_{EJ}$ in the first and third conveyance states are stored based on the rotational phases of the main conveyance roller 2 and the discharge roller 6 grasped in step S0803.

The conveyance amounts are stored in accordance with the phase fluctuation conveyance amounts L acquired in advance and the rotational phase intervals in which the phase fluctuation conveyance amounts L have been acquired. Note that the rotational phase $\theta_0$ indicates the rotational phase at the instant of switching to the second conveyance state.

The storage method will be described in detail. For example, if the rotational phase $\theta_0$ corresponds to the position ps2 shown in FIG. 5, the rotational phases $\theta_1$, $\theta_2$, . . . correspond to the positions ps3, ps4, . . . . Hence, the phase fluctuation conveyance amount $L_{LF2}$ is stored as a conveyance amount $\beta_{LF1}$ in the first conveyance state from the rotational phase $\theta_0$ to $\theta_1$. Similarly, $L_{LF3}$, $L_{LF4}$, . . . are stored as $\beta_{LF2}$, $\beta_{LF3}$, . . . . The conveyance amounts in the third conveyance state are also stored in accordance with the above-described method.

Next, the loads $F_1$, $F_2$, $F_3$, . . . , $F_n$, $F_{n+1}$, . . . applied to the main conveyance roller 2 are calculated. The loads can be obtained by substituting the already stored conveyance amounts $\beta_{LF}$ and $\beta_{EJ}$ into equation 5 of FIG. 13. In this embodiment, the load $F_0$ applied to the main conveyance roller 2 at the rotational phase $\theta_0$ is calculated by storing 0.

Any one of equations 4 of FIG. 13 is solved using the load F calculated here, thereby obtaining the conveyance amount $\beta_{LFEJ}$ in the second conveyance state. The values calculated in the above-described way are stored in the table shown in FIG. 9.

In step S0805, the printing operation is executed while correcting the rotation amounts of the main conveyance roller 2 and the discharge roller 6 based on the conveyance amount in the second conveyance state stored in the table shown in FIG. 9. Letting LA be the conveyance amount to actually convey the sheet, a rotational phase at which conveyance corresponding to the conveyance amount LA can be implemented is obtained, and driving of the conveyance motor 13 is controlled to execute conveyance up to the rotational phase.

More specifically, when conveying from the rotational phase $\theta_0$, the conveyance amounts $\beta_{LFEJ}$ in the second conveyance state are added like $\beta_{LFEJ1}+\beta_{LFEJ2}+\ldots$. The sheet is conveyed up to the rotational phase at which the conveyance amount LA is obtained. For example, if the conveyance amount LA corresponds to $\beta_{LFEJ1}+\beta_{LFEJ2}$, conveyance from the rotational phase $\theta_0$ to $\theta_2$ is executed.

Note that if the conveyance amount LA does not match the sum of the conveyance amounts $\beta_{LFEJ}$, a rotational phase at which a conveyance amount closest to the conveyance amount LA is obtained, and the rotation amount is finely adjusted from that rotational phase. For example, if the conveyance amount LA is slightly larger than $\beta_{LFEJ1}$, the rotation amount to finely adjust is $\phi$ (rad). In this case, the rotation amount is calculated by $\phi=\{(A-\beta_{LFEJ1})/\beta_{LFEJ2}\}*(\theta_2-\theta_1)$. When conveyance is executed by adding the thus calculated finely adjusted rotation amount $\phi$ to the rotation amount of the actual conveyance operation, the conveyance operation of the conveyance amount LA can be implemented.

Finally, in step S0806, the remaining printing operation in the second conveyance state and that in the third conveyance state are performed. As for the printing operation in the second conveyance state, conveyance may be done based on the method of step S0805 described above for the whole printing region of the second conveyance state. Alternatively, conveyance may be done by switching the conveyance correction method after the conveyance amount $\beta_{LFEJ}$ has stabilized to some extent. When the printing operation in the third conveyance state has ended, image printing on the whole region of the sheet is completed. After that, the sheet with the image printed is discharged onto the discharge tray by the discharge roller 6, thus completing the image printing operation.

As described above, in this embodiment, when transition to the second conveyance state has occurred, image printing can sequentially be performed by executing the conveyance operation based on the fluctuation in the load F. Image printing can be performed while suppressing the conveyance amount fluctuation. This makes it possible to cope with the conveyance amount fluctuation upon switching the conveyance state by canceling the conveyance amount fluctuation and avoid degradation in image quality.

Note that in this embodiment, the conveyance amount calculation at the time of transition to the second conveyance state is performed in step S0805 after the printing operation in the first conveyance state. However, the conveyance amount calculation need not always be performed at this timing and may be performed immediately after detection of the sheet leading edge position. If an arrangement capable of uniforming the rotational phases when the leading edge of the sheet enters the discharge roller 6 is provided, the conveyance amount can be calculated before sheet feeding. That is, the conveyance amount calculation may be performed in advance as long as the rotational phase upon switching to the second conveyance state can be grasped.

In this embodiment, the periphery of each roller is divided into eight rotational phase intervals for the descriptive convenience. However, the number of divisions is not limited to this. The time in which the transient load fluctuation occurs at the time of transition to the second conveyance state changes depending on the structures of the main conveyance roller 2 and the discharge roller 6, and the like. For example, if the roller rigidity is high, the load fluctuation is expected to occur for a short time. In this case, preferably, the periphery is divided as finely as possible to obtain more rotational phase intervals, and the transient load fluctuation is finely calculated. At this time, measurement may be performed by increasing the number of test patterns described above and shortening the pattern interval. Alternatively, the number of divisions may be increased by performing, for example, interpolation processing of the conveyance amounts measured without changing the pattern interval.

In this embodiment, when setting the phase fluctuation conveyance amounts L in FIG. 6, $L_{LF}$ and $L_{EJ}$ are actually measured in the first and third conveyance states. However, the conveyance states of the actual measurement target are not limited to those. That is, the phase fluctuation conveyance amounts may be set based on the actual measurement values in the first conveyance state and the second conveyance state (in this case, measurement values of actual conveyance amounts concerning $L_{LF}$ and $L_{LFEJ}$ are obtained). The phase fluctuation conveyance amounts may be set based on the actual measurement values in the third conveyance state and the second conveyance state (in this case, measurement values of actual conveyance amounts concerning $L_{EJ}$ and $L_{LFEJ}$ are obtained). If the second conveyance state is included in the actual measurement target, the conveyance amounts in the first and third conveyance states are calculated from the conveyance amounts in a known conveyance state using the two equations 1 in FIG. 13 and performing the same step as described above, thereby calculating the conveyance amount changes. However, the conveyance amounts in the second conveyance state of equations 1 in FIG. 13 need to be conveyance amounts in a state in which the load fluctuation is stable.

In this embodiment, correction is executed by storing the actual conveyance amounts. However, the values to be stored are not limited to the conveyance amounts. The conveyance amounts may be converted into correction values and stored. To do this, for example, a method of storing the shift between an ideal conveyance amount and an actual conveyance amount as a correction value is usable. At the time of image printing, the actual conveyance amount can be calculated by adding or subtracting the correction value to or from the ideal conveyance amount. Hence, the rotation amount is decided based on the calculated conveyance amount.

The present invention is applicable not only to a printing apparatus such as a printer but also to various kinds of conveying apparatuses for conveying various kinds of objects to be conveyed. An example is a sheet feed scanner.

Second Embodiment

In the first embodiment, to cope with a conveyance amount fluctuation upon switching the conveyance state, the conveyance amount fluctuation is canceled. Instead, the image printing timing may be controlled to suppress a shift of the printing position caused by the conveyance amount fluctuation at the time of conveyance state transition to the second conveyance state. An example of coping with the conveyance amount fluctuation based on the image printing timing will be described below while exemplifying a line-type printing apparatus.

A line-type printing apparatus simultaneously performs conveyance and image printing using a line-type printhead including printing nozzles arranged in the sheet width direction, unlike a serial printing apparatus. The characteristic features of the line-type printing apparatus will be explained first.

In all printing apparatuses including the line-type printing apparatus, the printhead needs to always exist at an ideal conveyance position at the timing when the printhead discharges ink. In a printing apparatus that alternately executes conveyance and printing, like the printing apparatus A of the first embodiment, the conveyance amount is corrected such that the printing medium stops at the ideal conveyance position before the printing operation.

In the line-type printing apparatus, however, since image printing is performed during conveyance, correction needs to be executed at a very early timing when the printhead discharges ink. In such a printing apparatus, it is more effective to correct the image printing timing of the printhead than to correct the conveyance amount of the printing medium.

Note that when the image printing timing is corrected finely in synchronism with the discharge timing of the printhead, degradation in image quality can be avoided. Hence, more pieces of conveyance amount information of the printing medium are obtained by dividing the roller periphery more finely than ⅛ division as the above-described embodiments. In this embodiment, thousands pieces of conveyance amount information are obtained for the respective slit intervals of the code wheel.

When the number of pieces of conveyance amount information increases, it is often difficult to acquire the phase interval conveyance amounts by pattern printing described in the first embodiment. Instead, for example, a method of directly reading the conveyance amount of the printing medium using an optical sensor can be employed. As the optical sensor, a laser Doppler sensor or the like is used, and a known technique is usable for this.

In this embodiment, assume a form in which conveyance amount information is acquired in advance in the factory or the like using an optical sensor provided outside the printing apparatus and stored in the printing apparatus.

Figure 10:
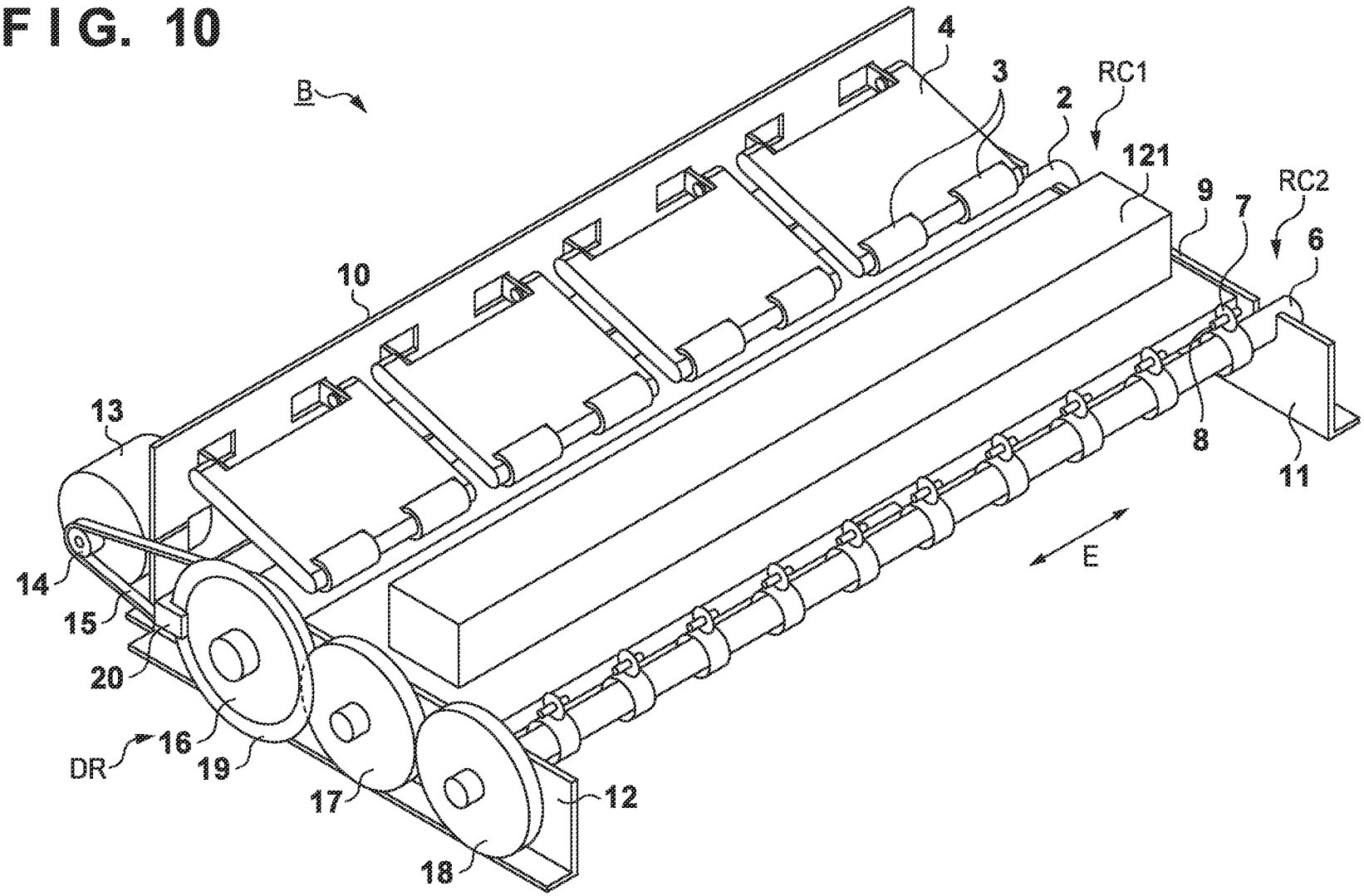
FIG. 10 is a perspective view of the mechanism unit of a printing apparatus according to another embodiment.

FIG. 10 is perspective view of the mechanism unit of a printing apparatus B according to this embodiment. As shown in FIG. 10, a printhead 121 is designed to cover the whole sheet width. The remaining mechanism units are the same as in the printing apparatus A of the first embodiment. Hence, the same reference numerals denote the same parts, and a description thereof will be omitted.

FIG. 11 is a view showing a table that stores phase fluctuation conveyance amounts of a main conveyance roller 2 and a discharge roller 6 according to this embodiment.

The concept of the method of acquiring the phase fluctuation conveyance amounts in the first and third conveyance states is basically the same as in the first embodiment except that instead of acquiring the conveyance amounts by printing test patterns as in the first embodiment, the conveyance amounts are acquired for each slit of a code wheel 19 during printing medium conveyance using an optical sensor provided outside the printing apparatus.

In this embodiment, the code wheel 19 is assumed to have 2,000 slits. The number of predetermined phase intervals is 2,000, that is, equals the number of slits. FIG. 11 shows rotational phase interval conveyance amounts L acquired in the first and third conveyance states according to this embodiment.

Figure 12:
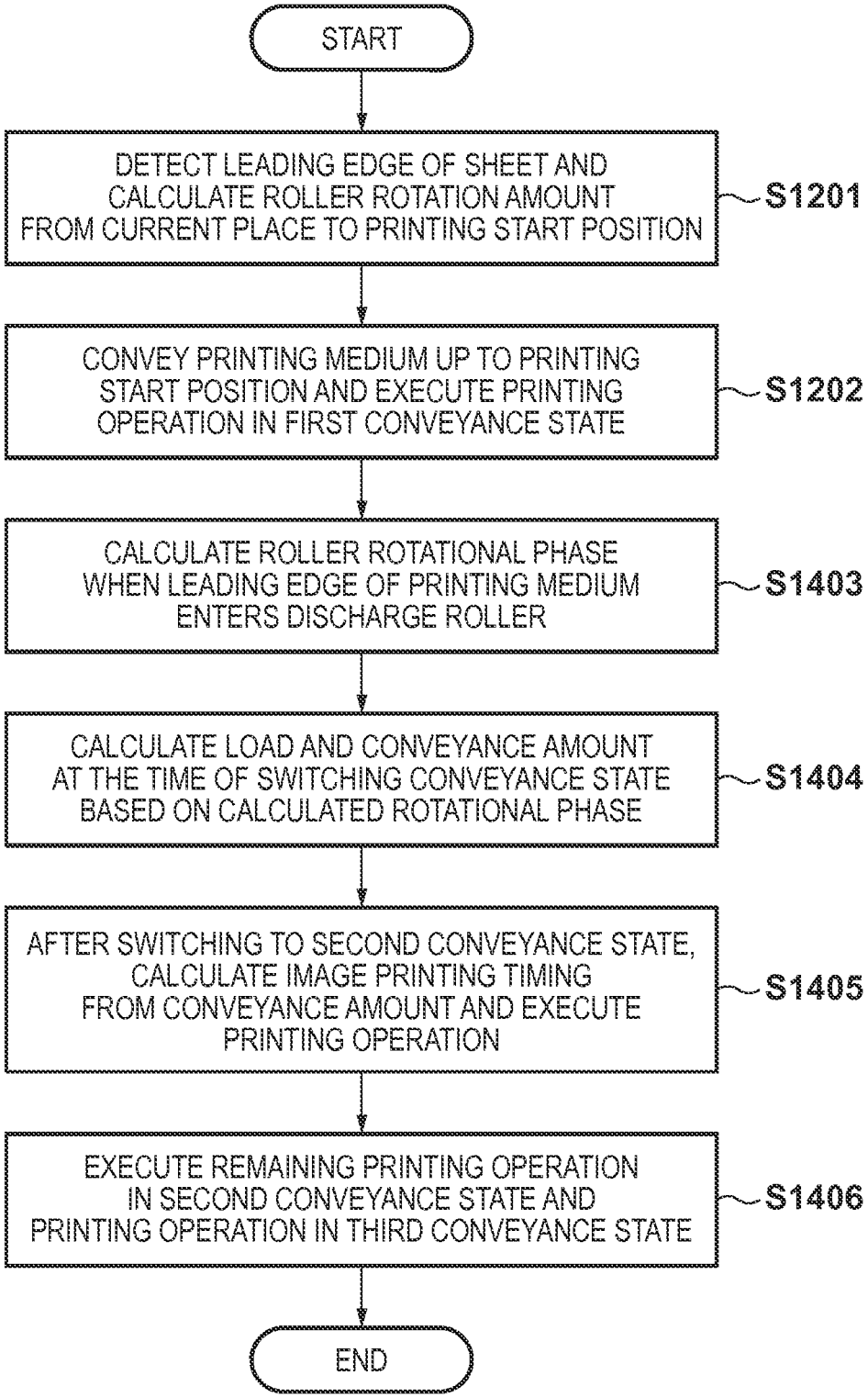
FIG. 12 is a flowchart of control at the time of a printing operation in the printing apparatus shown in FIG. 10.

An image printing timing correction method upon switching from the first conveyance state to the second conveyance state in the actual printing operation will be described next. FIG. 12 illustrates the correction control procedure in the actual printing operation.

The control procedure is also basically the same as in the first embodiment except that the correction target is not the rotation amount of the roller but the image printing timing. The processing from step S1405 in which the image printing timing is calculated, and the printing operation is executed will be described here assuming that the load applied to the main conveyance roller 2 and a conveyance amount $\beta_{LFEJ}$ in the second conveyance state have already been calculated.

In step S1405, the image printing timing is calculated using the previously calculated conveyance amount $\beta_{LFEJ}$ in the second conveyance state, and the printing operation is sequentially executed. Let LB be the conveyance distance from the conveyance position at the instant of switching to the second conveyance state to the ideal position of the next image printing. First, a rotational phase capable of implementing conveyance corresponding to the conveyance distance LB is obtained. The rotational phase that implements the conveyance distance LB can be calculated by adding the conveyance amounts $\beta_{LFEJ}$ in the second conveyance state, as in the first embodiment.

The rotation amount up to the thus calculated rotational phase is divided by the rotation speed of the main conveyance roller 2 and the discharge roller 6, thereby obtaining the conveyance time from the instant of switching to the second conveyance state to the next image printing. For example, assume that conveyance of the conveyance distance LB corresponds to conveyance up to a rotational phase $\theta_2$. Letting $\omega$(rps) be the rotation speed of the main conveyance roller 2 and the discharge roller 6, a conveyance time t (sec) is given by $$t=\{(\theta_2-\theta_0)/2\pi\}/\omega$$

After switching to the second conveyance state, image printing is executed after the conveyance time t. In subsequent image printing as well, the conveyance time t is decided based on the conveyance distance up to the ideal position of the next image printing and the rotational phase that implements the conveyance distance, and image printing is executed.

Sequentially executing image printing in the above-described way makes it possible to execute image printing in consideration of the transient load fluctuation. After step S1405 is completed, the printing operation in the remaining printing regions is executed in step S1406, as in the first embodiment.

As described above, the fluctuation in the conveyance amount upon switching the conveyance state is coped with by correction of the image printing timing, thereby avoiding degradation in image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2012-203543, filed Sep. 14, 2012, which is hereby incorporated by reference herein in its entirety.

What is claimed is:

1. A printing apparatus comprising:

a printhead that prints an image on a printing medium;

a first conveyance roller that is provided on an upstream side of said printhead along a conveyance direction and intermittently conveys a printing medium;

a second conveyance roller that is provided on a downstream side of said printhead along the conveyance direction and intermittently conveys a the printing medium;

a conveyance control unit configured to perform a conveyance control where a conveyance state is changed from a first conveyance state, in which said first conveyance roller conveys a printing medium and said second conveyance roller does not convey a printing medium, to a second conveyance state, in which said first conveyance roller and said second conveyance roller convey a printing medium, and then the conveyance state is changed from the second conveyance state to a third conveyance state, in which said first conveyance roller do not convey a printing medium and said second conveyance roller conveys a printing medium;

a calculating unit configured to calculate a load mutually acting on said first conveyance roller and said second conveyance roller through a printing medium in an intermittent conveyance operation in which the conveyance state is changed from the first conveyance state to the second conveyance state based on a rotational phase of said first conveyance roller and a rotational phase of said second conveyance roller when said second conveyance roller starts a conveyance of a printing medium in the intermittent conveyance operation and a rotational phase of said first conveyance roller and a rotational phase of said second conveyance roller when a printing medium is stopped in the intermittent conveyance operation, and a correcting unit configured to correct a conveyance amount in an intermittent conveyance operation in said second conveyance state based on the load calculated by said calculating unit.

2. The apparatus according to claim 1, wherein said calculating unit calculates the load later in the second conveyance state using the load when the conveyance state is changed from the first conveyance state to the second conveyance state as an initial value.

3. The apparatus according to claim 1, wherein said correcting unit corrects the conveyance amount so as to suppress a fluctuation in the conveyance amount, and the fluctuation in the conveyance amount includes at least the fluctuation in the conveyance amount resulted from displacement of said first conveyance roller and said second conveyance roller caused by the load.

4. The apparatus according to claim 1, further comprising a storage unit, wherein said storage unit stores a conveyance characteristic coefficient associated with a conveyance change amount with respect to a load of each of said first conveyance roller and said second conveyance roller, and a rigidity coefficient associated with a displacement amount with respect to a load of each of said first conveyance roller and said second conveyance roller, and a control amount for driving said rollers is set based on the conveyance characteristic coefficient, the rigidity coefficient, and the load.

5. The apparatus according to claim 1, wherein the printing apparatus comprises a serial printing apparatus configured to form the image by scanning said printhead in a direction perpendicular to the conveyance direction of the printing medium.

6. The apparatus according to claim 1, further comprising a storage unit configured to store conveyance amount information associated with the conveyance amounts for a predetermined rotational phase unit of said first conveyance roller and for the predetermined rotational phase unit of said second conveyance roller, wherein said calculating unit calculates the load based on the conveyance amount information.

7. The apparatus according to claim 6, wherein the conveyance amount information is set based on a measurement value of an actual conveyance amount of a printing medium in the first conveyance state and a measurement value of an actual conveyance amount of the printing medium in the third conveyance state, based on a measurement value of an actual conveyance amount of a printing medium in the first conveyance state and a measurement value of an actual conveyance amount of the printing medium in the second conveyance state, or based on a measurement value of an actual conveyance amount of a printing medium in the second conveyance state and a measurement value of an actual conveyance amount of the printing medium in the third conveyance state.

8. A conveying apparatus comprising:

a first conveyance roller configured to intermittently convey an object to be conveyed;

a second conveyance roller provided downstream relative to said first conveyance roller along a conveyance direction of the object to be conveyed and configured to intermittently convey the object to be conveyed;

a conveyance control unit configured to perform a conveyance control where a conveyance state is changed from a first conveyance state, in which said first conveyance roller conveys an object and said second conveyance roller does not convey an object, to a second conveyance state, in which said first conveyance roller and said second conveyance roller convey an object, and then the conveyance state is changed from the second conveyance state to a third conveyance state, in which said first conveyance roller do not convey an object and said second conveyance roller conveys an object;

a calculating unit configured to calculate a load mutually acting on said first conveyance roller and said second conveyance roller through an object in an intermittent conveyance operation in which the conveyance state is changed from the first conveyance state to the second conveyance state based on a rotational phase of said first conveyance roller and a rotational phase of said second conveyance roller when said second conveyance roller starts a conveyance of an object in the intermittent conveyance operation and a rotational phase of said first conveyance roller and a rotational phase of said second conveyance roller when an object is stopped in the intermittent conveyance operation, and a correcting unit configured to correct a conveyance amount in an intermittent conveyance operation in said second conveyance state based on the load calculated by said calculating unit.

9. A method of controlling a conveying apparatus including:

a first conveyance roller configured to intermittently convey an object to be conveyed; and a second conveyance roller provided downstream relative to the first conveyance roller along a conveyance direction of the object to be conveyed and configured to intermittently convey the object to be conveyed;

the method comprising:

performing a conveyance control where a conveyance state is changed from a first conveyance state, in which said first conveyance roller conveys an object and said second conveyance roller does not convey an object, to a second conveyance state, in which said first conveyance roller and said second conveyance roller convey an object, and then the conveyance state is changed from the second conveyance state to a third conveyance state, in which said first conveyance roller do not convey an object and said second conveyance roller conveys an object;

calculating a load mutually acting on said first conveyance roller and said second conveyance roller through an object in an intermittent conveyance operation in which the conveyance state is changed from the first conveyance state to the second conveyance state based on a rotational phase of the first conveyance roller and a rotational phase of the second conveyance roller when said second conveyance roller starts a conveyance of an object in the intermittent conveyance operation and a rotational phase of said first conveyance roller and a rotational phase of said second conveyance roller when an object is stopped in the intermittent conveyance operation, and correcting a conveyance amount in an intermittent conveyance operation in said second conveyance state based on the load calculated by said calculating step.

* * * * *